United States Patent [19]

Mahoney

[11] 4,266,479

[45] May 12, 1981

[54] MULTI-FUNCTION MECHANICAL PRINTER DRIVE MEANS

[75] Inventor: Frank A. Mahoney, Wyncote, Pa.

[73] Assignee: Sperry Corporation, New York, N.Y.

[21] Appl. No.: 64,833

[22] Filed: Aug. 8, 1979

Related U.S. Application Data

[63] Continuation of Ser. No. 859,787, Dec. 12, 1977, abandoned.

[51] Int. Cl.[3] ..... B41J 9/12

[52] U.S. Cl. ..... 101/93.09; 101/93.14

[58] Field of Search ..... 101/93.09, 93.14, 95, 101/99; 192/48.92; 74/810, 812, 665

[56] References Cited

U.S. PATENT DOCUMENTS

| | | | |
|---|---|---|---|
| 3,145,581 | 8/1964 | Schrecengost et al. | 74/810 X |
| 3,200,919 | 8/1965 | Lanigan et al. | 192/489 X |
| 3,385,213 | 5/1968 | Stephan | 101/99 X |
| 3,613,857 | 10/1971 | Thevis et al. | 400/226 X |
| 3,642,049 | 2/1972 | Lynan | 74/810 X |
| 3,672,297 | 6/1972 | Berglund et al. | 101/93.09 |
| 3,690,249 | 9/1972 | Nihica et al. | 101/95 |
| 3,727,734 | 4/1973 | Hansen | 192/48.92 |
| 3,990,361 | 11/1976 | Matsuboru | 101/93.09 X |

*Primary Examiner*—Edward M. Coven

*Attorney, Agent, or Firm*—Thomas J. Scott; Edward M. Farrell; William E. Cleaver

[57] ABSTRACT

A bi-directional printed circuit motor is coupled to drive at least a pair of one way clutches which selectively actuate one or more utilization devices dependent on the direction of the motor. The utilization devices may, for example, include a print hammer assembly, an inked ribbon and paper driver of a high speed printer in a computer system.

2 Claims, 3 Drawing Figures

MULTI-FUNCTION MECHANICAL PRINTER DRIVE MEANS

This is a continuation of application Ser. No. 859,787, filed Dec. 12, 1977, now abandoned.

In many high speed printers, a plurality of hammers are selectively actuated when a print mechanism, including type characters embossed thereon, is at certain positions. The paper and the inked ribbon are disposed between the hammers and the print mechanism so that movements of the hammers drive the paper against the type ribbon to cause selected characters to be printed.

In operating high speed printers of the type mentioned, a number of different functions must be performed, generally at different time periods and for different time intervals. For example, the paper is generally moved each time a full line is printed. The inked ribbon may be moving continuously or moved in increments after one or a number of lines are printed. In one embodiment of the subject invention, a third movement may involve stepping an assembly having a plurality of hammers back and forth transverse to the paper each time a line is printed, with the step being equal to the space of a single character being printed.

Heretofore, separate motors have been employed to move the paper, inked ribbon and perform other functions. This multiplicity of motors has added to the mechanical complexity, space requirements and costs of the printer systems involved.

It is an object of this invention to provide a novel mechanism for selectively performing one or more mechanical operations.

It is a further object of this invention to provide improved means for selectively performing one or more functions to the exclusion of others in a high speed printer of a computer system.

It is still a further object of this invention to provide an improved mechanism for selectively performing one or more functions to the exclusion of the others with a minimum number of parts in a high speed printer.

In accordance with the present invention, a bi-directional printed circuit motor is provided. As least two one way coupling devices connect the motor to a plurality of utilization devices. At least one of the coupling devices is responsive when the motor is driven in one direction and at least one of the other coupling devices is responsive when the motor is driven in the opposite direction. The selected utilization devices actuated are dependent upon which of the one or more coupling devices is responsive to the motor. In a preferred embodiment, the utilization devices are included in a high speed printer of a computer system.

Other objects and advantages of the present invention will be apparent and suggest themselves to those skilled in the art, from a reading of the following specification and claims, taken in conjunction with the accompanying drawing, in which:

Figure 1:
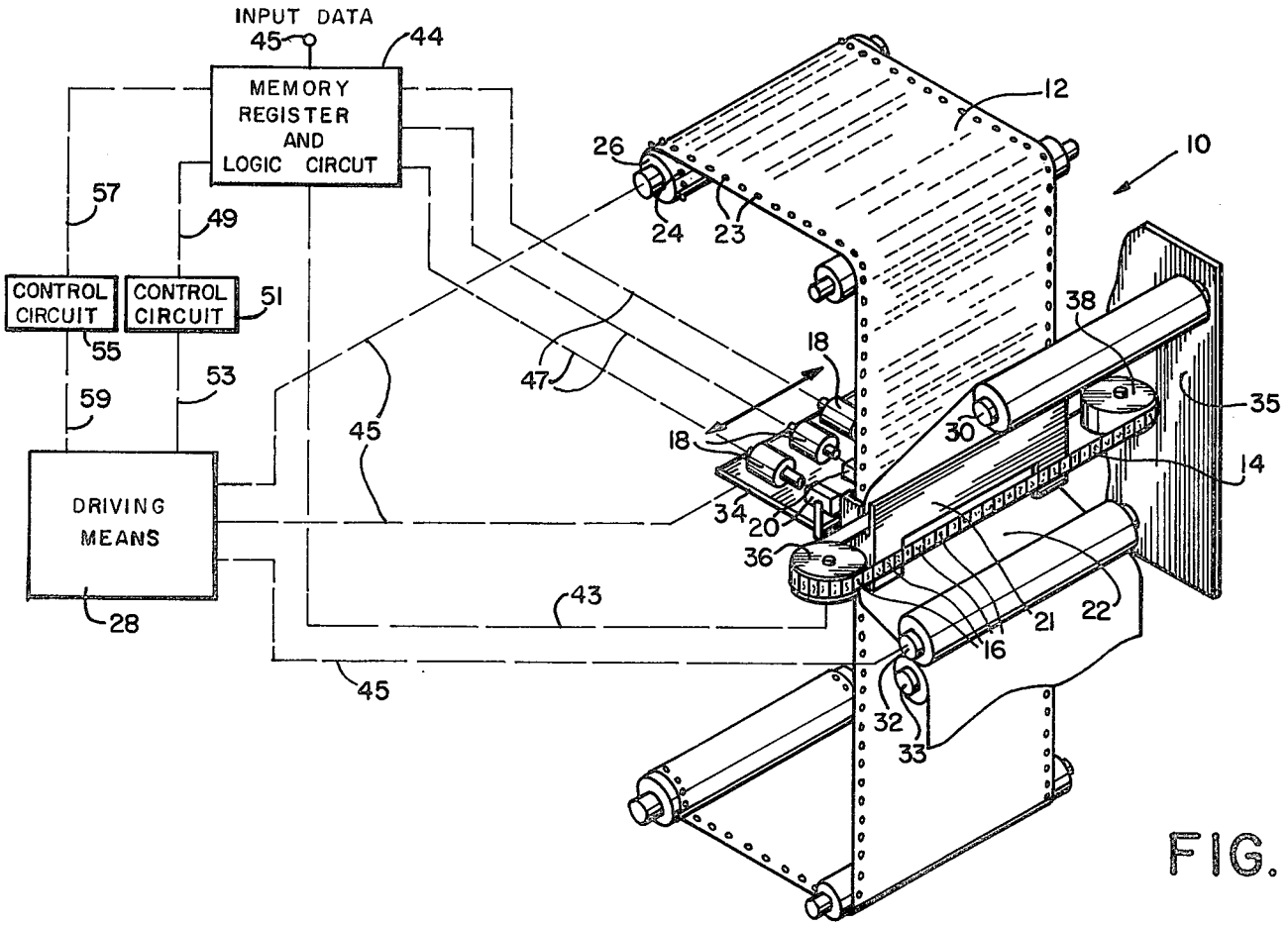
FIG. 1 is an isometric view illustrating some of the main parts of a high speed printer, partly in block diagram form, in accordance with the present invention.

Referring now to FIG. 1, a high speed printer 10 may comprise part of a computer system and is used to receive and print output data therefrom on a paper 12 or other suitable means for receiving indicia thereon. The printer itself is generally of the conventional type. The printer illustrated is designed to print a full or partial line of data and then advance the paper 12 to its next designated location. The printer 10 is of the so-called "on-the-fly" type printer in which a continuous print band 14 having raised characters 16 thereon, is moved laterally at high speed with respect to the paper 12. Printing is accomplished by selectively driving solenoids 18 to selectively actuate hammers 20 when the appropriate characters of the print band 14 are opposite the proper column or selected portion of the paper on which characters are to be printed. A back up plate 21 is disposed behind the print band 14 to absorb the impact of the print hammers. The plate may be "C" shaped so that the portion facing the hammers is open. Also, the plate keeps the paper, inked ribbon and print band from being torn or frayed. An inked or film ribbon 22 is disposed between the paper 12 and the portion of the print band 14 adjacent the paper 12 to mark the characters thereon.

The indicia receiving sheet or paper 12 may be of the type generally used in computer readout and has a plurality of uniformly spaced sprocket openings 23 along its outer edges. These openings are adapted to receive a plurality of similarly spaced pins 24 which are circumferentially disposed on both ends of a drive roller 26. Each time a line of type is printed, the roller 26 is stepped counterclockwise a distance equal to one or more lines by a driving means 28, the details of which will be described hereinafter in connection with FIG. 2.

The inked ribbon 22, or other suitable means for producing indicia on the paper 12, is dispensed from supply means 30 which may be a roller, box or the like, which may be suitably mounted to a housing 35, and passed between take up pinch rollers 32 and 33, which are closely biased towards each other so that rotation of the roller 32 will cause the roller 33 to also be rotated. After one portion of the inked ribbon has been used a selected number of times, either one or more times, the ribbon is moved in any desired increments by the driving means 28 stepping the take up pinch roller 32 in a counterclockwise direction and the roller 33 in a clockwise direction. For example, in one embodiment, the ribbon may be advanced one sixth of an inch for eight shifts of the print system. Because the ribbon is moved in relatively small planned increments rather than random large increments corresponding to a full line of indicia or print out, the ribbon may be discarded after use.

The solenoids 18 and print hammers 20 may be mechanically connected to be stepped back and forth and are illustrated as being mounted to a hammer assembly 34. The assembly 34 may comprise a suitable housing, platform or the like. Each of the hammers 20, driven by solenoids 18 or any other suitable means, are dimensioned to strike one of the characters on the print band 14. The hammers 20 are aligned in spaced relationship with respect to each other so that there are spaces therebetween corresponding to a minimum of the width of one character.

In operation, one half of a line is first printed by the hammers 20. The hammer assembly 34 is then stepped one space by the driving means 28. The hammers 20 are then aligned properly to print the other half of the line before the paper 12 is stepped to the next line. The hammer assembly is shifted back and forth each time one full line is printed. A conventional line printed in many computer systems comprise 132 characters and normally require 132 hammers and solenoids. In the embodiment illustrated, only 66 hammers and solenoids are required.

The various movements involving the paper, inked ribbon and hammer assembly, while somewhat related in their sequence of operation, take place at different times, may last for different time intervals, and require different types of movements. Signals over lines 45 control these movements.

The various timing operations for determining the start and stop of the movements described may be related to the movement of the print band which is driven by a pair of rollers 36 and 38 by conventional means well known to those skilled in the art and therefore not illustrated.

The print band 14 may include sprocket or timing signals thereon which are applied to a memory register and logic circuit 44 through a line 43. The timing signals provide the means whereby the exact position of the print band 14 may be sensed at all times so as to actuate the appropriate hammers at the proper times to print the desired characters. Appropriate AND gate and other logic circuits may be used with the timing signals and the characters stored in the memory register to actuate the hammers 20. When the type band is located in the desired positions as determined by the timing signals, the appropriate signals from the memory register 44 cause the correct hammers to be actuated. These features per se are known to those skilled in the art. Therefore a further detailed description thereof is unwarranted.

The memory register 44 receives the output data to be printed from a computer (not illustrated) through input means 45. The output signals from the memory register 44, representing the characters to be printed, are selectively applied over lines 47 to selective solenoids 18, which in turn drive the appropriate hammers 20.

After the memory register 44 has dispensed with signals for producing characters for one half a line, a signal is generated at a line 49 by any well known means and applied to a control circuit 51. The control circuit 51 generates an electrical signal of appropriate amplitude, polarity and duration, which is applied to the driving means 28 through a line 53. The control circuit may include suitable amplifiers, inverters and the like responsive to pulse signals which are well known to those skilled in the art. Because such circuitry is only incidental to the present invention, it is not illustrated in detail.

A second output signal from the memory register 44 is generated after a full line of data has been printed and is applied to a control circuit 55 through an output line 57. Signals at appropriate amplitude, duration and polarity are applied from the control circuit 55 through an output line 59 to the driving means 28. The output signals from the control circuits 51 and 55 are of opposite polarities to drive the driving means 28 in different directions. Again the means for generating a signal after a full line of data has been transferred from the memory register and may take a wide variety of different forms. For example, the memory register may be examined to determine that all the stored information has been transferred to actuate the appropriate hammers. If pulse signals are generated after each line, they may be used to form signals at appropriate amplitude and polarity to drive the driving means.

Figure 2:
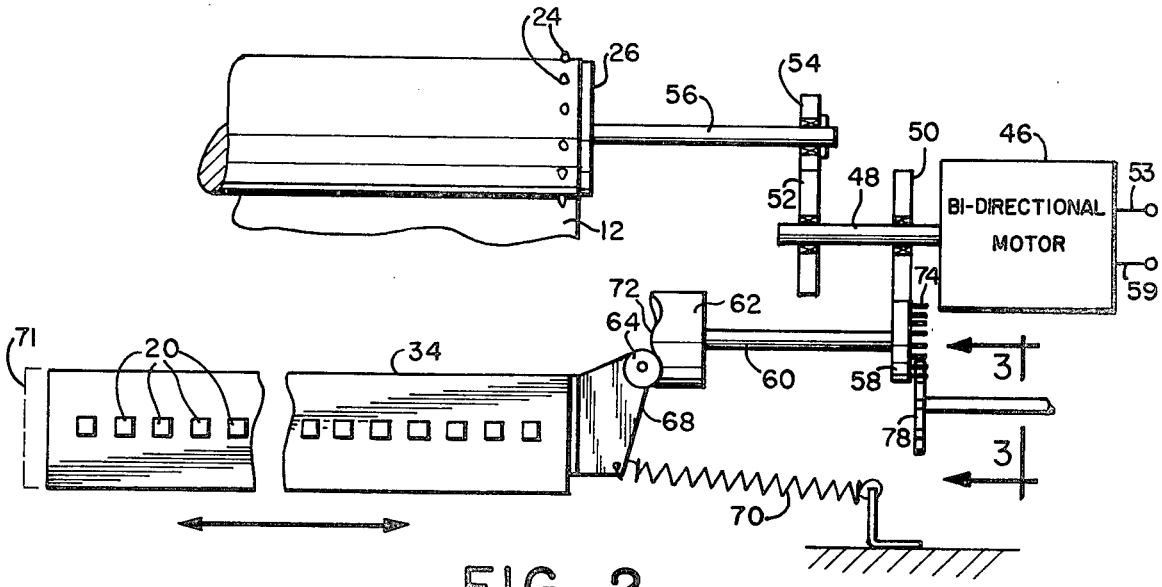
FIG. 2 is a schematic diagram illustrating the subject invention in greater detail as related to the components illustrated in FIG. 2.
Figure 3:
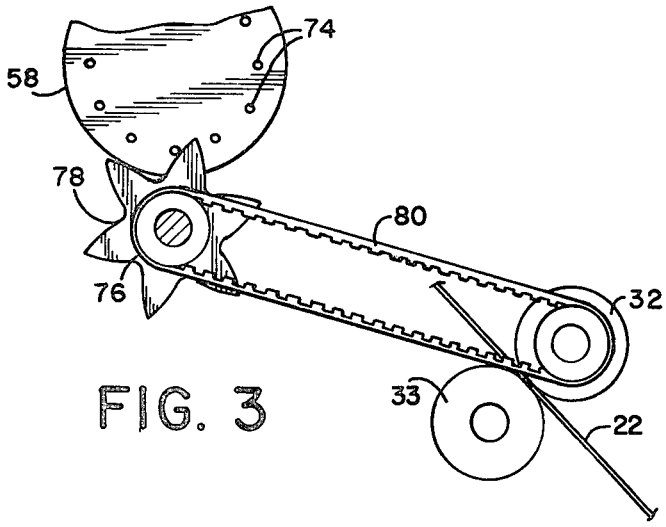
FIG. 3 is a view taken along lines 3—3 of FIG. 2.

Referring to FIGS. 2 and 3, along with FIG. 1, the driving means 28 (FIG. 1) comprises a bi-directional printed circuit motor 46 (FIG. 2) suitably driven by control signals from lines 53 and 59 connected to the control circuits 51 and 55. The bi-directional printed circuit motor 46 may be driven to be rotated in steps in a first direction or the opposite direction dependent upon the polarity or nature of the electrical signals applied thereto. Printed circuit motors, capable of being rotated continuously or in steps, upon the application of electrical signals thereto, are available from Printed Motor Division of Kollmorgen Corporation, Syosset, New York. Such applied signals may be in the form of pulses or otherwise and may be of different polarities to drive the motor in opposite directions.

As shown in FIG. 2, the motor 46 includes an output shaft 48 connected to a pair of one way clutches 50 and 52. The clutches 50 and 52 are of the types so as to respond in opposite manners with respect to each other, i.e., when the shaft 48 is driven in one direction the first clutch 50 is responsive while the other clutch 52 remains non-responsive. Likewise, when the shaft 48 is driven in the opposite direction, the other clutch 52 is responsive while the first clutch 50 remains non-responsive.

Such one-way clutches are well known. Such clutches are employed to provide a means for transmitting power when the driver, in this case the shaft 48, is rotating in one direction but which will automatically release if the direction of rotation is reversed. One type of one-way or overruning clutch is illustrated in a textbook entitled "Principles of Mechanical Design" by Robert E. Parr, Copyright, 1970, on page 312. Also, one way clutches are manufactured by a number of different companies and are well known to those skilled in the art.

The one-way clutch 52 is connected to drive a roller or gear wheel 54. The wheel 54 is connected to a drive shaft 56 which drives the paper roller 26. The roller 26 is driven one step to move the paper 12 as each line is printed as a result of the bi-directional motor 46 rotating in a first direction. When the clutch 52 drives the paper roller 26, the clutch 50 is not driven by the shaft 48.

When the bi-directional motor 46 is driven in the opposite direction, the shaft 48 is also driven in the opposite direction. Under these conditions, the one-way clutch 50 is driven and the one-way clutch 52 remains non-responsive. The clutch 50 drives a wheel or gear 58.

The wheel 58 is connected to a drive shaft 60 which is connected to a lobe cam 62. The lobe cam 62 engages a roller 64. The roller 64 is connected to an extension arm 63 with the arm 68 being connected to the hammer assembly 34 and the arm 68 being connected to a bias spring 70. In the position illustrated, the hammer assembly 34 is spring biased towards the right.

When the shaft 60 is rotated about a small angle, the roller 64 rides up the lobe 72. The hammer assembly 34 is then moved an increment towards the left, to a position indicated by dotted lines 71. The lobe cam 62 is dimensioned to move the hammer assembly 34 a distance corresponding to the width of one character or one hammer. It is thus seen that the hammer assembly 34 may be actuated in two steps to print an entire line. First, one half a line is printed, i.e., 66 characters in a conventional system. The hammer assembly 34 is then stepped to the left with the second half of the line then being printed, again 66 characters making a total of 132 characters printed. This arrangement makes it possible to print a line with half the number of hammers and actuators normally used.

A third function performed by the bi-directional motor 46 again involves the wheel or gear 58. Reference is made to FIG. 3 along with FIG. 2. The wheel 58 includes a plurality of spaced pins 74 disposed close to its circumference. The pins are disposed to engage a sprocket or gear type wheel 76 having a plurality of protruding teeth like portions 78 extending between adjacent pins 74. The number of pins 74 is related to the number of protruding portions 78 so that the wheel 76 may be moved in any desired increments.

The roller 76 is connected to a drive belt 80, which acts as a timing belt to actuate the pinch rollers 32 and 33 to move the ribbon 22. In some cases, several shifts of the hammer assembly 34 or steps of the paper roller 12 are performed before it is necessary to move the inked ribbon 22 a single increment.

The present invention has provided relatively simple means for selectively actuating one or more of a plurality of utilization devices at different times, for different time intervals and in different increments. The tri-functional bi-directional motor makes it possible to minimize the number of drive motors necessary for printing and for moving the inked ribbon and paper in a high, medium, or low speed printer. Consequently costs and space requirements are correspondingly reduced.

What is claimed is:

1. In a high speed printer including a band having raised characters thereon, means for moving a print receiving medium, means for moving an inking medium, and means for moving as assembly having print hammers thereon, an improvement for selectively actuating one or more of said means for moving comprising:

(a) a bi-directional printed circuit motor for selectively driving a drive shaft in a first or second direction, (b) first coupling means including a first one-way clutch connected to said drive shaft and having a first output shaft connected to actuate said means for moving said print receiving medium in response to movement of said first one way clutch each time a full line of print is printed on said print receiving medium, (c) second coupling means including a second one way clutch connected to said drive shaft for actuating said means for moving said inking ribbon in response to movement of said drive shaft in a second direction after a selected number of lines have been printed on said print receiving medium, (d) said second coupling means including a wheel disposed to be driven by said second one way clutch having a plurality of spaced pins close to its circumference and a sprocket wheel connected to actuate said inking ribbon with projecting portions extending between said spaced pins, (e) third coupling means for actuating said means for moving said assembly to periodically shift said assembly having print hammers thereon one character of print in response to movement of said drive shaft in said second direction, (f) a roller on said assembly, (g) said third coupling means including a second output shaft having a lobe cam connected to said wheel of said second coupling means with said lobe cam engaging said roller on said assembly to shift said assembly having print hammers thereon each time one half a line is printed on said print receiving medium;

(h) said third coupling means further including an arm connected to a biasing means to shift said assembly in a first direction when said roller is in a first position with respect to said lobe cam and to shift said assembly in a second opposite direction in response to said biasing means when said roller is in a second position with respect to said lobe cam.

2. In a high speed printer as recited in claim 1 wherein said second coupling means further includes timing belt means coupled between said sprocket wheel and said means for moving said inking medium whereby said inking medium is moved only one increment in response to displacing said wheel a desired number of increments.

* * * * *